US006302069B1

(12) United States Patent
Moyer

(10) Patent No.: US 6,302,069 B1
(45) Date of Patent: Oct. 16, 2001

(54) CAM ACTIVATED ELECTRICALLY CONTROLLED ENGINE VALVE

(76) Inventor: David F. Moyer, 5 Weatherby Rd., Hanover, NH (US) 03755-1923

( * ) Notice: Subject to any disclaimer, the term of this patent is extended or adjusted under 35 U.S.C. 154(b) by 0 days.

(21) Appl. No.: 09/707,634

(22) Filed: Nov. 8, 2000

Related U.S. Application Data

(63) Continuation-in-part of application No. 09/585,778, filed on Jun. 5, 2000, which is a continuation-in-part of application No. 09/519,635, filed on Mar. 6, 2000.

(51) Int. Cl.[7] ..... F01L 9/04; F01L 13/00

(52) U.S. Cl. ..... 123/90.11; 123/90.16; 123/90.17; 123/90.6; 123/90.65

(58) Field of Search ..... 123/90.11, 90.15, 123/90.16, 90.17, 90.6, 90.65

(56) References Cited

U.S. PATENT DOCUMENTS 4,870,930 * 10/1989 Yagi ..... 123/90.11
4,917,056 * 4/1990 Yagi et al. ..... 132/90.16
4,930,463 * 6/1990 Hare, Sr. ..... 123/90.11
5,653,198 8/1997 Diggs ..... 123/90.15

* cited by examiner

*Primary Examiner*—Weilun Lo

(57) ABSTRACT

This invention describes an engine valve control responsive to electrical signals from a controller to open and close a valve. Power to move the valve comes from a camshaft. A disabler spring is compressed by a cam lobe and held compressed by its solenoid while the valve is held from opening by its solenoid. When the valve solenoid releases the valve, a half oscillation between the disabler spring and valve spring opens the valve and the valve solenoid than holds it open. The disabler solenoid then releases the disabler spring. When the valve solenoid releases its spring, a half oscillation of the two springs closes the valve with a soft landing. The valve operation is very fast, independent of engine speed, and can be controlled over 630 crankshaft degrees. The camshaft may run at crankshaft speed with valve disablement during compression and expansion strokes for 4 stroke operation. 2 stroke operation may be used for compressor and air motor operation as a pneumatic hybrid engine.

14 Claims, 2 Drawing Sheets

CAM ACTIVATED ELECTRICALLY CONTROLLED ENGINE VALVE

CROSS-REFERENCE TO RELATED APPLICATIONS

This application is a continuation in part which discloses and claims subject matter disclosed in my earlier pending application Ser. No. 09/585,778 filed on Jun. 5, 2000 which is a continuation-in-part of Ser. No. 09/519,635 filed Mar. 6, 2000. This continuation describes improvements and simplification to the valve disabler described in the previous application.

BACKGROUND OF THE INVENTION

The present invention relates to the field of internal combustion engines, more particularly to a method of controlling the engine intake and exhaust valves so as to produce a more efficient combustion process within the cylinder and to operate the engine as a pneumatic hybrid.

This invention describes a method for increasing the flexibility of the present valve control. While the general principles and teachings disclosed are applicable to all valve controlled internal combustion engines, the invention is hereinafter described in detail in connection with its application to a reciprocating, cam and valve, multi-cylinder engine.

The poppet valve driven by a camshaft has been used in the internal combustion engine for many years. Modifications to the valve train have been developed to permit changing the valve timing while the engine is in operation. When the timing control prevents the valves from opening during an engine cycle, the cylinder is disabled, and the effect of a variable displacement engine is obtained. The advantage of a variable displacement engine is that when less than maximum efficiency power is required, some of the cylinders may be disabled and the remaining active cylinders' power is increased so that they will operate at greater efficiency, while the engine output remains constant. This approach has had limited success in practice because the usual control activates or deactivates half the number of cylinders, and this abrupt change in output torque causes poor drivability. Furthermore, the disabling mechanism is relatively slow acting so that more than one revolution of the crankshaft is required to make the change.

All of the differences cited with the prior art referenced in my previous applications (Ser. Nos. 09/519,635 & 09/585,778) apply to the present invention. Another example of prior art is the FINGER FOLLOWER ROCKER ARM SYSTEM in U.S. Pat. No. 5,653,198 by Diggs issued Aug. 5, 1997. This invention describes a disabler mechanism controlled by a rotary solenoid with the camshaft providing the power to move the valve. The rotary solenoid shifts the follower away from the cam so no force is transmitted to the valve stem. The shape of the cam lobe still determines the valve action when activated. The intent of the invention is to engage and disengage the cam during the time when the valve is inactive as shown in FIG. 7, because of the high forces involved with valve action. The conventional cam lobe is shaped to accelerate and decelerate the valve at a given time in the engine cycle, and this system cannot change those times. The present application does not have these limitations. The spring energy taken from the camshaft is stored for release at any time to separately open and close the valve, and the valve accelerations are determined by the interchange of energy between two springs. The resonant oscillation between the two springs insures a "soft" valve landing at the oscillation extremes whenever the springs are released.

BRIEF SUMMARY OF THE INVENTION

The object of this invention is to improve the response of the engine intake and exhaust valves to electrical signals of the engine controller which directs a valve to open or close. A further object is to have the camshaft supply the power to move the valves. A further object is for the valves to operate rapidly, and be independent of engine speed in their response time. A further object is have the valves operate with minimum opening and closing impact, noise, and vibration. A further object is to be able to open and close the valves anywhere within at least 630 degrees of two crankshaft rotations. A further object is to allow the camshaft to rotate at crankshaft speed to facilitate two cycle compressor and air motor operation of the engine as a pneumatic hybrid.

The present invention accomplishes these objects in an improvement on my previous referenced applications. It uses only one of the holding solenoids previously described, together with a double acting solenoid which can be activated to hold its plunger in two different positions. Further, it shows a unique method of resuming operation after the electrical power to the engine has been shut down from the previous operation.

BRIEF DESCRIPTION OF THE SEVERAL VIEWS OF THE DRAWING

All figures are schematic representations of the valve control mechanism for an internal combustion engine.

Reference Number Identifications

Figure 1:
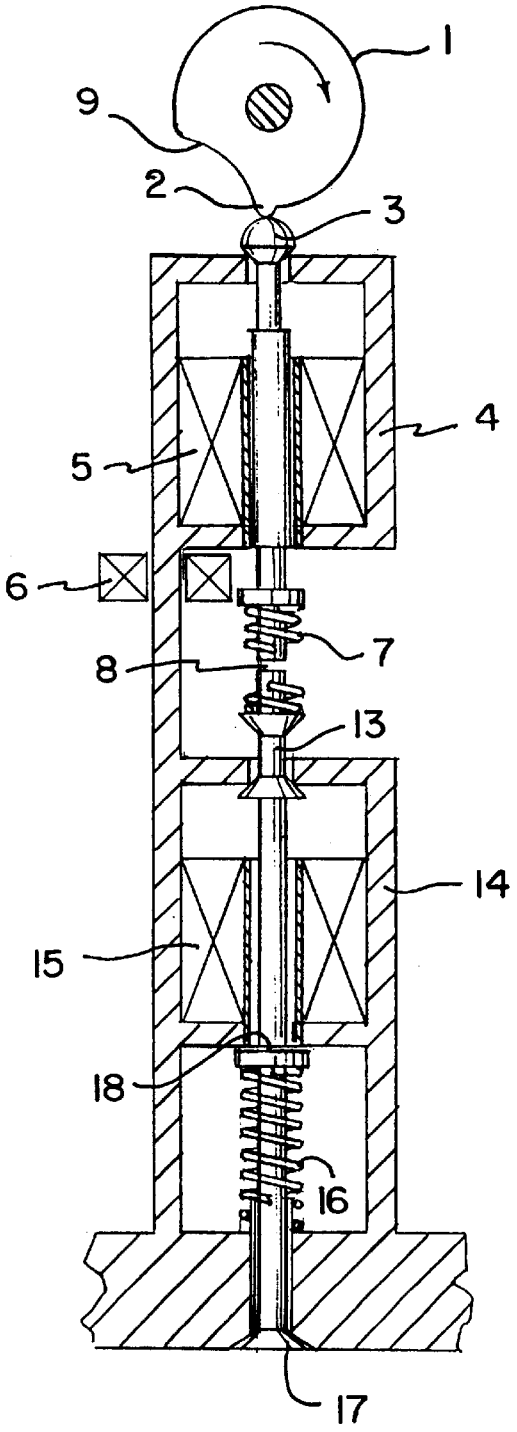
FIG. 1 shows the cam energy delivered to the disabler spring.

1. Cam 9.
2. Cam Lobe
3. Disabler Soleniod Plunger
4. Disabler Solenoid
5. Disabler Solenoid Coil
6. Sensing Coil
7. Disabler Spring
8. Air Gap
9. Anti-Lobe
13. Valve Solenoid Plunger
14. Valve Solenoid
15. Valve Solenoid Coil
16. Valve Spring
17. Valve
18. Lash Adjustment

DETAILED DESCRIPTION OF THE INVENTION

This invention involves controlling the energy transfer between the valve spring 16 and a disabler spring 7, with two solenoids 4 & 14 which hold and release the springs. To begin operations with both solenoids de-energized, consider FIG. 1. The engine is cranked in the usual manner and sensing coil 6 has a small sensing current applied. This current determines the inductance change due to air gap 8 variation as cam 1 rotates.

The acceleration portion of cam lobe 2 is located on cam 1 at a point where valve 17 is not operative, and the deceleration portion of a conventional cam lobe is omitted as unnecessary. Anti-lobe 9 and acceleration lobe 2 occupy less than 90 degrees of cam 1, running at crankshaft speed, leaving at least 630 degrees of two crankshaft rotations for operation of valve 17.

Just before cam lobe 2 acts on plunger 3, as shown in FIG. 1, cam anti-lobe 9 has allowed plunger 3 to relieve the pressure on both disabler spring 7 and valve spring 16, and valve 17 closes. At that time, the controller (not shown) energizes valve solenoid 14 and it is held closed magnetically. The plunger 13 is conically shaped at the point where it contacts the square stator end, resulting in a 2 point contact with resulting high magnetic holding force. When lobe 2 compresses disabler spring 7, the controller energizes disabler solenoid 4, holding spring 7 for release when valve opening is desired. FIG. 1 shows this condition with small lash adjustment 18 assuring full seating of valve 17.

When the controller de-energizes valve solenoid 14, disabler spring 7, having higher force and more stored compression energy, begins to push the valve open while further compressing valve spring 16. This transfer of compression energy between the springs causes an oscillation of the system mass.

Disabler spring 7 lengthens and valve spring 16 shortens during this first half of the oscillation. To assure that valve spring 16 is fully compressed and valve 17 is fully opened, spring 7 has a greater compression rate than spring 16. The springs will have the same change in length (one shorter, the other longer), but spring 7 has the greater rate to provide the additional energy to overcome the maximum system friction. This greater rate is proportional to the total energy required divided by the opening energy required. If the sensing gap indicates less than the maximum friction, the controller de-energizes solenoid 4 at a time to insure the proper oscillation amplitude for valve 17 to be fully open with no overshoot.

Figure 2:
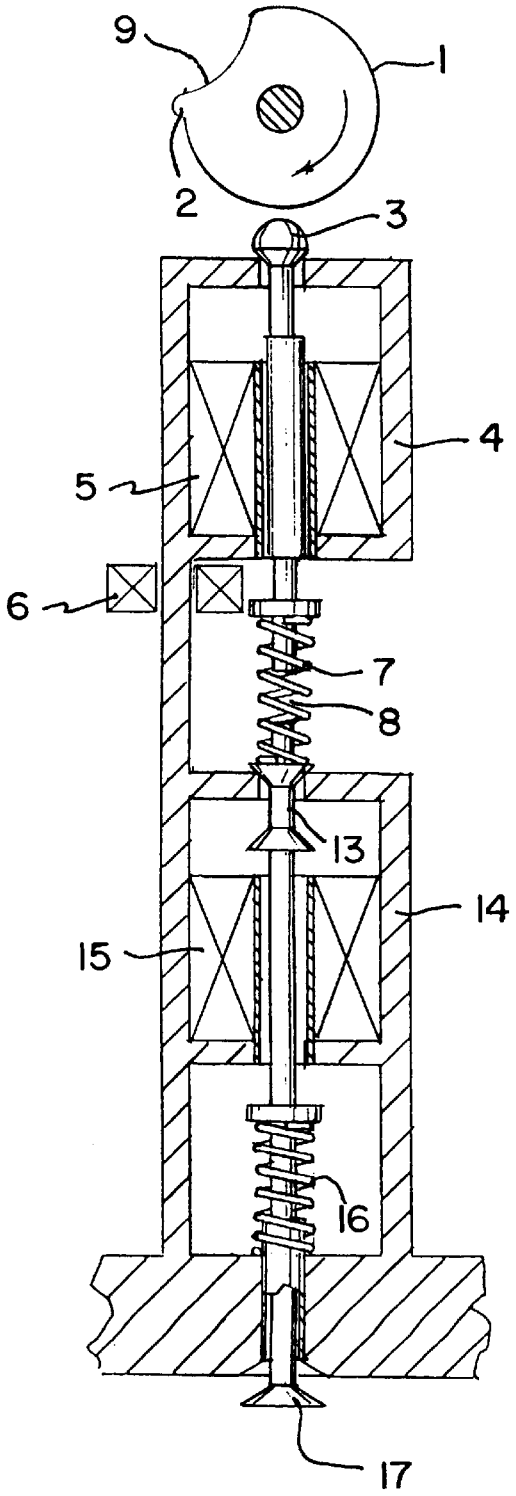
FIG. 2 shows the disabler spring after opening the valve and compressing the valve spring.
Figure 3:
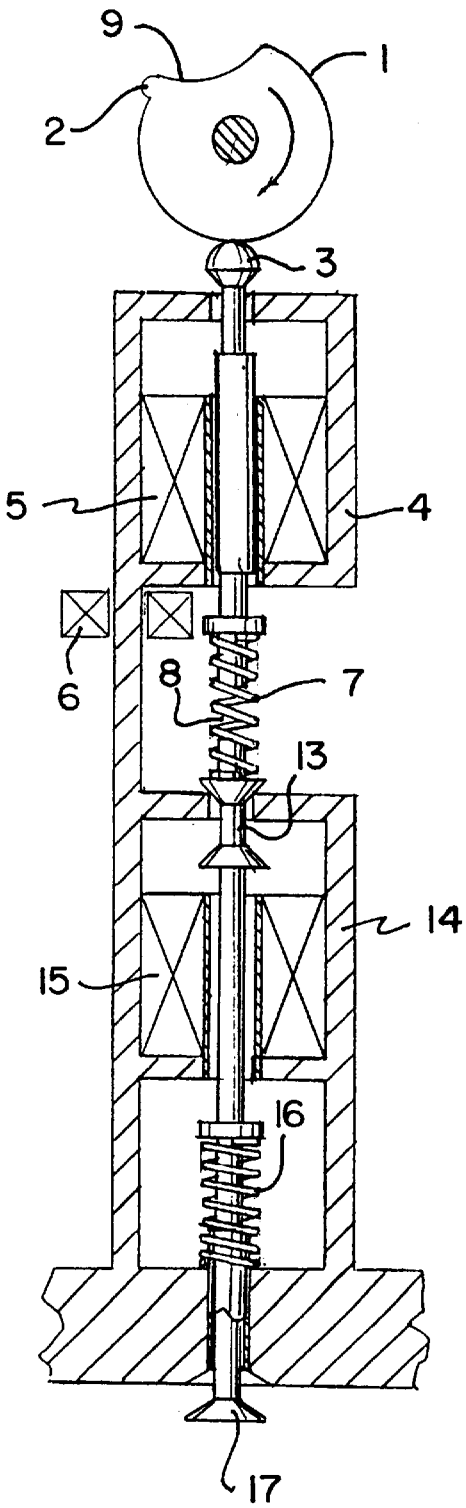
FIG. 3 shows the disabler spring released in order to receive the energy of the valve spring when the valve closes.

FIG. 2 shows the condition with valve 17 open under maximum friction conditions with solenoid 4 still energized since all the stored energy in spring 7 was used during the opening. FIG. 3 shows the condition with valve 17 open and plunger 3 being in contact with the cam 1 land when there has been less than maximum friction. It may be appropriate to include an energy absorbing air dashpot (not shown) as described in my previous application (Ser. No. 09/585,778; FIG. 1, part 19 and claim 8).

Figure 4:
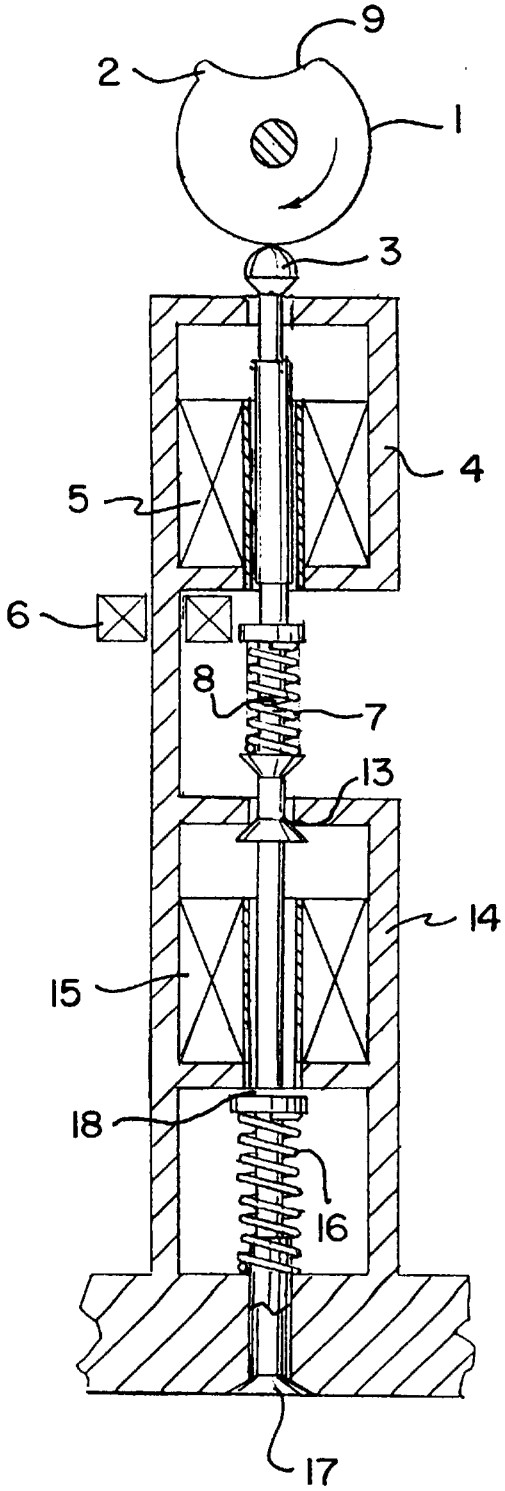
FIG. 4 shows the valve closed, the disabler spring having received the valve closing energy.

When the valve is to close, the controller de-energizes valve solenoid 14 and the second half of the oscillation begins. The energy content of disabler spring 7 with plunger 3 on cam 1 land is such that the closing oscillation will also have its maximum amplitude just as the valve reaches its seat. This results in the closed valve condition shown in FIG. 4.

During the following cam 1 revolution, lobe 2 again compresses disabler spring 7 and disabler solenoid 4 is energized to hold spring 7 compressed. If the control strategy calls for valve 17 to be disabled during the next cycle or cycles, cam 1 rotates without doing any work on the valve system. When the time comes for valve 17 to open, valve solenoid 14 opens as in FIG. 2 and the cycle proceeds as before described.

This valve control system results in a full opening and closing of valve 17 in a very short time since the spring oscillations are independent of engine speed. Thus the throttling of the engine, when necessary, can be accomplished by valve control with minimum throttling losses. The same fast acting, soft landing valve control can provide rapid and accurate exhaust gas recirculation control (EGR) without the mass of an EGR valve. Further engine improvements may be obtained by changing the cycle times during which those throttling and EGR actions take place.

Based on the foregoing description of my invention, what I claim is:

1. A valve operating system for at least one cylinder valve of an internal combustion engine comprising:

a camshaft with at least one cam for each said valve, said cam having at least one lobe with means for compressing a disabler spring;

at least one said disabler spring with means for opening said valve;

at least one valve spring with means for closing said valve;

a means by which said valve spring and said disabler spring may exchange energy;

a first solenoid with means for holding said disabler spring in compression;

a second solenoid with means for holding said valve in both open and closed positions;

an engine controller with means to separately energize and de-energize said solenoids.

2. The valve operating system of claim 1 wherein said cam has an anti-lobe with means to expand said disabler spring and said valve spring enough to close said valve when neither of said solenoids are energized.

3. The valve operating system of claim 1 wherein said cam lobe has said compressing means sufficient to deliver the energy to open and close said valve and overcome the friction involved in said valve operation.

4. The valve operating system of claim 1 wherein the acceleration portion of said lobe is located on said cam at a point where said engine valve is not operative and the deceleration portion of said lobe is omitted.

5. The valve operating system of claim 1 wherein said disabler spring has a spring rate with means to supply said valve opening energy as well as the frictional energy required during said valve opening.

6. The valve operating system of claim 1 wherein a plunger of said first solenoid seats magnetically against a stator of the first solenoid with a minimum point contact and the upper end of said plunger follows the contour of said cam when said first solenoid is de-energized.

7. The valve operating system of claim 1 wherein a plunger of said second solenoid has two separate cone sections with each separately having minimum points of contact with a stator of the second solenoid, and is magnetically held in the upper or lower position depending upon when said second solenoid is energized.

8. The valve operating system of claim 1 wherein both said solenoids have plunger extensions within said disabler coil, a magnetic connection between their stators, and a sensing coil on said connection whose inductance varies with movement of said plunger extensions.

9. The valve operating system of claim 1 wherein the camshaft rotates at crankshaft speed for 2 cycle engine operation, and with means of disabling valves every other crankshaft rotation for 4 cycle engine operation.

10. An engine valve operating system comprising these elements:

a valve spring which urges an engine valve to the closed position;

a disabler spring having a compression rate greater than said valve spring;

a first solenoid having a plunger which restrains one end of said disabler spring;

a second solenoid having a plunger which restrains the other end of said disabler spring;

said engine valve which is urged to said closed position by said valve spring and is urged to the open position by said disabler spring.

11. The engine valve operating system of claim 10 is a resonant system comprised of the mass of said elements and said disabler spring and said valve spring which exchange energy in oscillation.

12. The engine valve operating system of claim 11 wherein said solenoids control the release of said energy from one said spring to the other said spring and limit said oscillations to one half of a cycle.

13. The engine valve operating system of claim 11 wherein said solenoids end each said oscillation at or near their maximum amplitude and minimum speed.

14. The engine valve operating system of claim 11 wherein said disabler spring rate is proportionately larger than said valve spring rate so that equal length changes of said springs will provide for the maximum frictional losses in said oscillations.

* * * * *